United States Patent [19]

Wagner

[11] 4,178,024

[45] Dec. 11, 1979

[54] ROD LOCK FOR DOORS OR GATES HAVING TWO WINGS

[76] Inventor: Remigius Wagner, Schulhausstrasse 12, Wetzikon, Switzerland

[21] Appl. No.: 919,362

[22] Filed: Jun. 26, 1978

[30] Foreign Application Priority Data

May 7, 1977 [CH] Switzerland ..... 8299/77
Jul. 5, 1977 [CH] Switzerland ..... 8299/77

[51] Int. Cl.[2] ..... E05C 5/02

[52] U.S. Cl. ..... 292/57; 292/148; 292/DIG. 21

[58] Field of Search ..... 292/42, 4, 146, 148, 292/189, 183, 184, 190, 191, 57, DIG. 21, DIG. 29

[56] References Cited

U.S. PATENT DOCUMENTS

| | | | |
|---|---|---|---|
| 370,773 | 10/1887 | Forg | 292/146 |
| 927,824 | 7/1909 | Welch | 292/146 |
| 1,355,371 | 10/1920 | Welsh | 292/189 X |
| 2,481,154 | 9/1949 | Rousseau | 292/146 X |
| 2,940,790 | 6/1960 | Ingalls | 292/189 X |
| 3,174,314 | 3/1965 | Johnson | 292/148 X |
| 3,582,122 | 6/1971 | Foster | 292/DIG. 21 X |
| 4,005,886 | 2/1977 | Lirette | 292/DIG. 21 X |
| 4,099,753 | 7/1968 | Gwozoz | 292/DIG. 21 X |

FOREIGN PATENT DOCUMENTS

| | | | |
|---|---|---|---|
| 344249 | 3/1931 | United Kingdom | 292/57 |

*Primary Examiner*—J. Franklin Foss
*Attorney, Agent, or Firm*—Gordon W. Hueschen

[57] ABSTRACT

A rod lock for doors or gates having two wings, comprising a locking rod or bar mounted at one wing for vertical displacement. The locking rod, in its closed position, engages into a recess or depression in a floor or the like. The other wing has at least one stop or impact member against which bears the wing having the locking rod. A door lock is effective between both of the wings. At least two guide rings are provided in which the locking rod is vertically displaceable and rotatable about its lengthwise axis. A locking or closure element mounted at the rod is pivotable together with the rod and intended to engage in its closed position between the mutually contacting door wings. A retarding or inhibiting element at the counter-wing prevents lifting of the locking element and thus the locking rod or bar.

10 Claims, 2 Drawing Figures

ROD LOCK FOR DOORS OR GATES HAVING TWO WINGS

BACKGROUND OF THE INVENTION

The present invention relates to a new and improved construction of a rod or bar locking arrangement for doors or gates having two wings, hereinafter generally broadly referred to simply as door or door wings, although this term is used in its broadest sense to encompass gate wings and other entrance and exit door-like or gate-like elements.

The rod lock arrangement of the present invention is of the type comprising a locking rod or bar which is mounted at one wing for vertical displacement, this locking rod engaging in a recess or other suitable depression at the ground or floor in its closed position. At least one stop or impact member is provided at the other wing and against which there bears the wing equipped with the locking rod. Additionally, a door lock is provided between both of the wings.

Doors or gates having two wings, especially gates at the entrance way of buildings or other real estate, garden gates and so forth, formed either as iron structures or as wooden structures, were not capable heretofore, of being provided with any effectively satisfactory solution for positively locking in a simple manner the door or gate wing locked with a rod or bar or the like. Additionally, there is furthermore existent the problem of effectively bracing at the floor or ground the frequently extremely heavy door wings, in order to avoid any excessive loading of the actual door suspension.

SUMMARY OF THE INVENTION

Hence, it is a primary object of the present invention to provide a new and improved construction of rod locking arrangement for doors and gates having two wings which is not associated with the aforementioned drawbacks and limitations of the prior art proposals.

Another and more specific object of the present invention aims at providing a new and improved construction of a rod locking arrangement for doors or gates having two wings, which can be employed both as a support and as a positive locking unit.

An additional object of the invention is to structure the lock so that it can be used both for doors formed as iron structures and also those formed of wooden construction.

The proposed rod locking or closure arrangement of the previously mentioned type is manifested by the features that there are provided at least two guide rings in which the locking rod or bar is guided so as to be vertically displaceable and rotatable about its lengthwise axis. A locking or closure element is mounted at the locking rod and is pivotable in conjunction with such rod and intended in its closed position to engage between the mutually contacting door wings. Further, there is provided a retarding or inhibiting element at the other or counter wing which prevents lifting of the locking or closure element and thus the locking rod.

According to a particularly advantageous constructional embodiment of the invention it is intended at least one of the guide rings for the locking rod is provided with fixing means in order to arrest the locking rod in a random vertical position. Such fixing means can comprise, for instance, a clamping screw in the form of a quick or snap closure mechanism. Further, the locking element is preferably adjustably mounted at the locking rod.

The locking element is advantageously constructed as an angle-shaped element, and, for instance, mounted at an adjustment ring upon the rod. This angle-shaped locking element can be provided, for instance, with a threaded bolt, which, in turn, can be threaded into an adjustment ring at the locking rod. By means of this threaded bolt it is simultaneously possible to fix the locking element in the desired position at the rod. The locking element, which usually serves as a lifting handle for the locking rod, advantageously possesses the shape of a hand grip or the like. The retarding or inhibiting element for the locking element in the closed position can be designed as a separate stop or, for instance, formed in one of the stops or impact members for the door wing.

According to a particularly advantageous constructional embodiment the lower end of the locking rod is provided with a pointed element. Due to this point or tip the related door wing also can be arrested in a random open position at the floor or ground.

The rod lock or rod locking arrangement for doors or gates according to the invention insures for a complete locking security, is aesthetic in appearance and shape, and furthermore, exceptionally easy to mount or assemble. The operation of the rod lock is extremely simple, the entire construction exceptionally stable and sturdy. The locking arrangement can be readily mounted at existing doors or the like.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
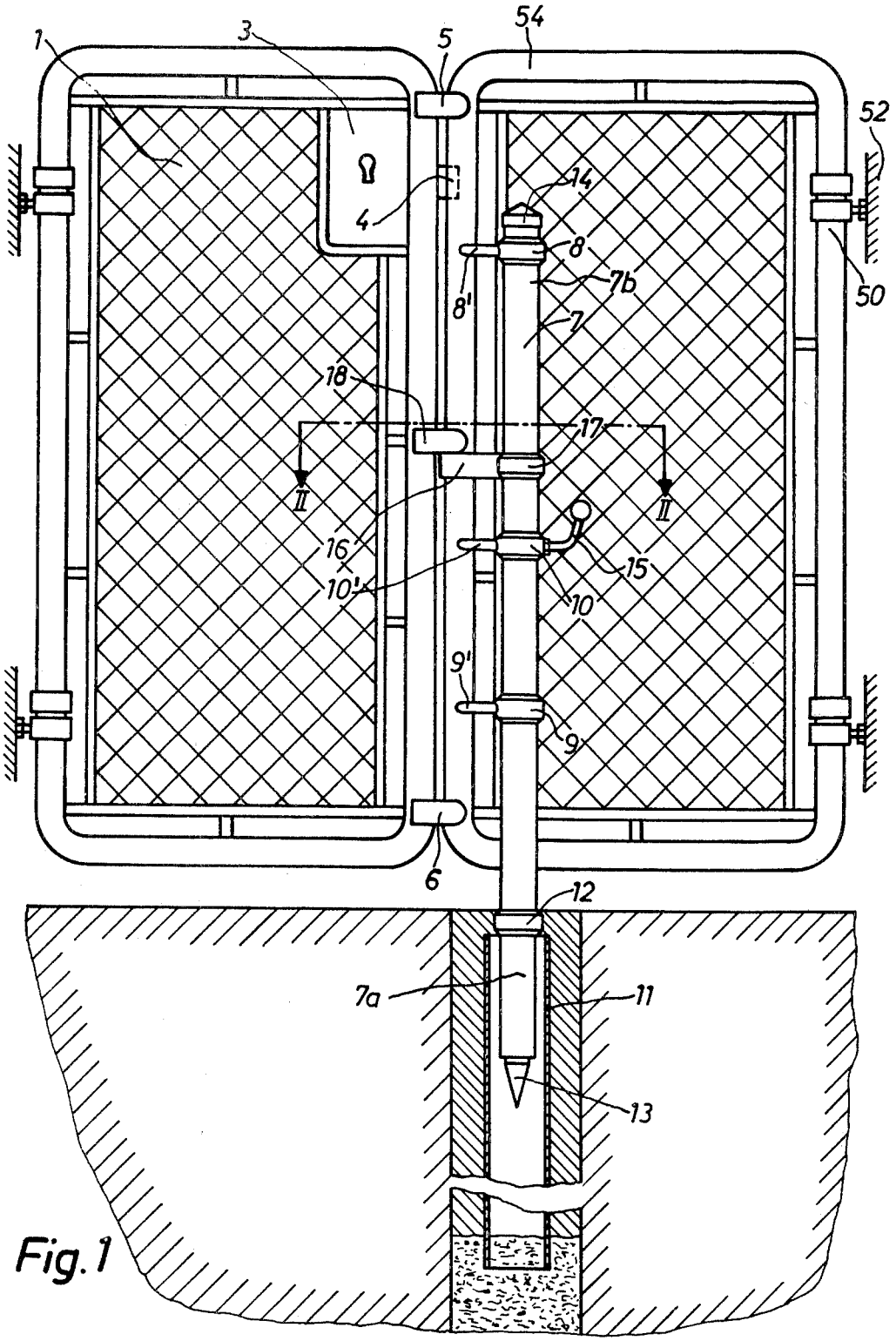
FIG. 1 is a front view, partly in section, looking from the inside of a double-door, which is equipped with a rod locking arrangement or rod lock according to the present invention.

Describing now the drawings, the double-gate illustrated by way of example in FIG. 1 will be seen to comprise the two door or gate wings 1 and 2, which, in the illustrated exemplary embodiment, are formed of metal. The door or gate wings 1 and 2—hereinafter conveniently usually referred to simply as door wings—are pivotably suspended in conventional manner by suitable hinge units or structures 50 at walls or posts, generally indicated by reference character 52. The one wing 1 is provided with a closable lock 3 wherein the bolt 4 either engages into the frame 54 of the other wing 2 or engages therebehind. At the inside of the door wing 1 there are either welded or threaded two stops or impact members 5 and 6. The second door wing 2 in its closed position bears against the stops or impact members 5 and 6. At the second wing 2 there are arranged the elements of the inventive rod locking arrangement. A locking rod or bar 7, composed of a metal tube or pipe, is mounted in guide elements in the form of guide rings 8, 9 and 10, so as to be both vertically displaceable and rotatable about its lengthwise axis. In the closed position of the gate or the like the lower portion 7*a* of the locking rod 7 engages into a floor or ground anchoring tube 11 defining the floor or ground recess or depression. Obviously, other suitable holes or recesses for receiving the lower end or portion 7*a* of the locking rod or bar 7 can be utilized. With the illustrated embodiment a door support 12, which may be mounted if desired to be displaceable, insures that the locking rod 7 only can penetrate to a certain extent or through a certain path into the receiving tube 11. At the lowermost end of the locking rod 7 there is provided a point or tip 13, which, when the gate structure is open, serves as a gate position fixing device. At the upper end 7*b* of the locking rod or bar 7 there is provided a cap 14 which serves, on the one hand as a cover for the tubular member of the locking rod 7, and, on the other hand, can be fixed such that the locking rod 7 can not slide out of the guide ring 8.

The guide rings 8, 9 and 10 are attached by means of extension arms 8', 9' and 10', respectively, at the frame 54 of the door wing 2, either by welding or by screws or equivalent fastening means. In the guide ring 10 there is provided a fixing screw 15, constructed as a quick or snap closure device, by means of which the locking rod 7 can be fixed or locked in any random desired elevational position. In the first instance there is used this possibility of fixing the locking rod 7 for the purpose of stabilizing such locking rod in its closed position, and furthermore, for fixing the locking rod in a position suitable for supporting the related door or the like, or simply for raising the locking rod into a lifted position.

The actual locking mechanism comprises a locking or closure element 16 which is threaded at a ring 17 and can be fixed at a predetermined location along the locking rod 7. The locking element 16, advantageously having the shape of a flexed or angled handgrip, in the closed position, engages between and through both of the door wings 1 and 2. The locking element 16 can be brought into this position by simply rocking or pivoting the same, of course before the door wing 1 has been brought into the closed position. The rocking or pivoting motion is extremely simple, since the locking rod 7 is rotatably mounted in the guide rings 8, 9 and 10.

Figure 2:
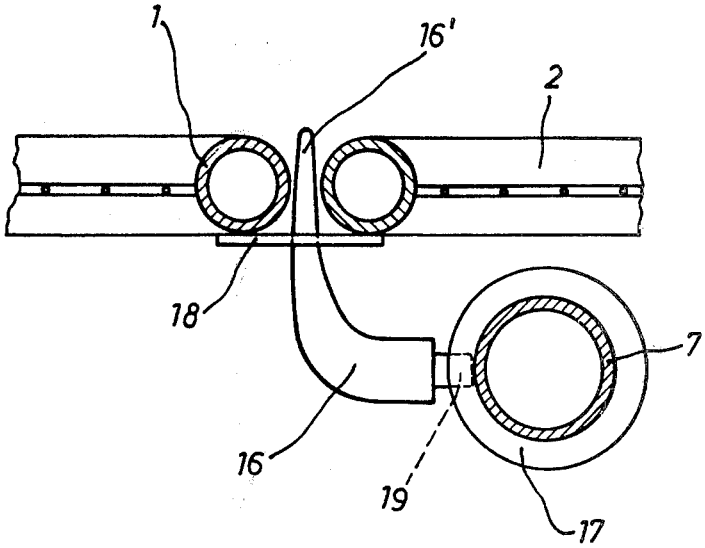
FIG. 2 is a cross-sectional view of the structure shown in FIG. 1, taken substantially along the line II—II thereof.

By virtue of the angled partial piece or section 16 of the locking element, as best seen by referring to FIG. 2, with the doors closed it is not possible to rock out the locking rod 7 and the locking element 16 out of its position between the door wings 1 and 2.

A retarding or inhibiting element in the form of a stop or impact member 18 is located directly over the locking element 16 at the door wing 1. By virtue of this stop or impact member 18 it is impossible to lift the locking rod 7 in this position of the doors or door wings 1 and 2. Hence, the illustrated construction affords an absolutely secure locking device for the gate or the like, and this of course, in conjunction with the lock 3.

As already mentioned, the locking element 16 can be fixed in a random elevational position by displacing the ring 17. The ring 17 itself is attached to the locking rod or bar 7 in that a threaded bolt 19 is screwed in, and this bolt 19 simultaneously serves as part of the locking element 16.

Of course, the entire construction also can be fabricated in the form of wooden gates or doors, and the individual elements of the locking arrangement are not connected by welded bonds or connections, rather through screw connections. As already mentioned, the different locking elements or parts also simultaneously can form a gate or door position-fixing device.

FIG. 2 of the drawings shows in an enlarged scale schematically a section along the line II—II of FIG. 1 and from which there will be seen details of the actual locking element 16.

While there are shown and described present preferred embodiments of the invention, it is to be distinctly understood that the invention is not limited thereto, but may be otherwise variously embodied and practiced within the scope of the following claims. Accordingly,

What is claimed is:

1. A rod locking arrangement for doors or gates having two wings, comprising:
   - a locking rod capable of being mounted at one wing for vertical displacement;
   - said locking rod being movable into a closed position where it engages with a floor recess;
   - at least one stop member provided at the other wing against which bears the wing having the locking rod;
   - a door lock effective between both of the wings;
   - at least two guide rings for guiding the locking rod for vertical movement and for rotational movement about its lengthwise axis;
   - a locking element mounted at the locking rod and pivotable together with said locking rod;
   - said locking element engaging between both of the wings bearing against one another in the closed position thereof; and
   - a retarding element for preventing lifting of the locking element and thus the locking rod.

2. The rod locking arrangement as defined in claim 1, wherein:
   - one of the guide rings for the locking rod is provided with fixing means for positionally fixing the locking rod in a random vertical position.

3. The rod locking arrangement as defined in claim 2, wherein:
   - said fixing means comprises clamping screw means.

4. The rod locking arrangement as defined in claim 1, further including:
   - means for mounting said locking element to be adjustable at the locking rod.

5. The rod locking arrangement as defined in claim 4, wherein:
   - said locking element possesses a substantially angle-shaped construction; and
   - an adjustment ring arranged at the locking rod and at which the angle-shaped locking element is mounted.

6. The rod locking arrangement as defined in claim 5, wherein:
   - said angle-shaped locking element embodies an angle-shaped part equipped with a threaded bolt and threaded into said adjustment ring; and
   - said threaded bolt simultaneously serving for fixing the locking element in a desired position at the locking rod.

7. The rod locking arrangement as defined in claim 1, wherein:
   - said locking element is essentially in the form of a handgrip and serves as a lifting grip for the locking rod.

8. The rod locking arrangement as defined in claim 1, wherein:

said retarding element comprises stop means for the door wings.

9. The rod locking arrangement as defined in claim 1, wherein:

said locking rod has a lower end structured as a pointed element.

10. A rod locking arrangement for doors or gates having two wings, comprising:

a locking rod capable of being mounted at one wing for vertical displacement;

said locking rod being movable into a closed position where it engages with a floor recess;

at least one stop member provided at the other wing against which bears the wing having the locking rod;

at least two guide rings for guiding the locking rod for vertical movement and for rotational movement about its lengthwise axis;

a locking element mounted at the locking rod and pivotable togehter with said locking rod;

said locking element engaging between both of the wings bearing against one another in the closed position thereof; and a retarding element for preventing lifting of the locking element and thus the locking rod.

* * * * *